US012320233B2

(12) United States Patent
Nomme et al.

(10) Patent No.: US 12,320,233 B2
(45) Date of Patent: Jun. 3, 2025

(54) PRESSURE ACTUATED VALVE FOR USE DURING INSTALLATION AND COMMISSION OF A PRODUCTION STRING

(71) Applicant: InflowControl AS, Porsgrunn (NO)

(72) Inventors: Christian Nomme, Skien (NO); Bjornar Werswick, Langesund (NO)

(73) Assignee: InflowControl AS, Porsgrunn (NO)

( * ) Notice: Subject to any disclaimer, the term of this patent is extended or adjusted under 35 U.S.C. 154(b) by 0 days.

(21) Appl. No.: 18/033,074

(22) PCT Filed: Oct. 25, 2021

(86) PCT No.: PCT/EP2021/079497
§ 371 (c)(1),
(2) Date: Apr. 21, 2023

(87) PCT Pub. No.: WO2022/090132
PCT Pub. Date: May 5, 2022

(65) Prior Publication Data

US 2023/0392474 A1 Dec. 7, 2023

(30) Foreign Application Priority Data

Oct. 26, 2020 (NO) ..... 20201163

(51) Int. Cl.
*E21B 34/10* (2006.01)
*E21B 23/00* (2006.01)
*E21B 43/12* (2006.01)

(52) U.S. Cl.
CPC ..... *E21B 34/102* (2013.01); *E21B 23/006* (2013.01); *E21B 43/12* (2013.01)

(58) Field of Classification Search
CPC ..... E21B 43/12; E21B 23/006; E21B 34/102; E21B 34/14
See application file for complete search history.

(56) References Cited

U.S. PATENT DOCUMENTS

| | | | | |
|---|---|---|---|---|
| 11,346,183 | B2 * | 5/2022 | Mair | E21B 23/04 |
| 11,774,002 | B2 * | 10/2023 | Chen | F16K 31/363 137/1 |
| 2002/0157837 | A1 | 10/2002 | Bode | |
| 2011/0067886 | A1 | 3/2011 | Moen | |
| 2013/0277059 | A1 | 10/2013 | Holderman | |
| 2020/0018136 | A1 * | 1/2020 | Bowen | E21B 34/14 |

FOREIGN PATENT DOCUMENTS

| | | |
|---|---|---|
| WO | WO2013/139601 A | 9/2013 |
| WO | WO2014/035252 A | 3/2014 |
| WO | WO 2014/149049-X | 9/2014 |

* cited by examiner

*Primary Examiner* — Yong-Suk (Philip) Ro
(74) *Attorney, Agent, or Firm* — Christian D. Abel

(57) ABSTRACT

The present invention relates to a system and a pressure activated valve for preventing fluid from passing through an ICD during installation and commissioning of a production string in a well bore. Further the invention relates to a method for operating the pressure activated valve. The pressure activated valve can be arranged outside the production string being configured to hinder fluid from entering the ICD from a reservoir when the pressure activated valve is closed and to allow fluid from entering from the reservoir when pressure activated valve is open.

10 Claims, 9 Drawing Sheets

PRESSURE ACTUATED VALVE FOR USE DURING INSTALLATION AND COMMISSION OF A PRODUCTION STRING

FIELD OF THE INVENTION

The invention concerns a pressure activated valve to prevent fluid from flowing through an inflow control device during installation and commissioning of a production string of a wellbore.

BACKGROUND OF THE INVENTION

A well for producing hydrocarbons from a subterranean reservoir may extend through the reservoir in a number of orientations. Traditionally, reservoirs were accessed by drilling vertical wells. This is simple and straight-forward technique, but one which provided limited reservoir contact per well. Therefore, in order to access more of a reservoir per well, techniques and devices were developed to drill horizontal wells, i.e. turning the well from vertical to horizontal at a predetermined depth below the surface. So-called multilateral wells provide even greater access to—and contact with—the reservoir.

To increase the ability to recover the oil present in the reservoir, Inflow Control Devices (ICDs) are placed in the production string wall. Typically, a production string in a horizontal well comprises a large number of ICDs disposed at regular intervals along its entire length. The ICDs serve as inflow ports for the oil that flows from the reservoir (normally via the annulus between the production string and the well formation) and into the production string, and are ports having a fixed flow area. So-called autonomous ICDs (AICDs and AICVs) have a variable flow area and comprise one or more valve elements and are normally open when oil is flowing through the device but chokes the flow when and where water and/or gas enters the production string. The annulus between the production string and the casing is typically divided into zones by zonal isolation packers, e.g. annulus inflatable packers, mechanical packers or swellable packers, which is known in the art. One or more ICDs or autonomous ICDs are then placed in each zone.

During installation and commissioning of the production string, it is important to have control of the fluid and hydrostatic pressure within the production string avoiding formation fluids e.g. formation gas, entering the production string.

However, some autonomous ICDs allow at least a small amount of fluid to pass through the autonomous ICD even when in choking/closed position. This can be due to a pilot/secondary flow path of the autonomous ICDs which regulates the valve element(s) as this path is always open. Hence, the fluid and pressure within the production string is not fully controlled. Hence, a closed system is desirable.

The purpose of the present invention is to overcome the shortcomings of the prior art and to obtain further advantages.

SUMMARY OF THE INVENTION

The invention is set forth and characterized in the main claims, while the dependent claims describe other characteristics of the invention.

The inventive system comprises a pressure activated valve (PAV) mounted between a sand-screen and an ICD or autonomous ICD. The PAV is preferably closed during installation and commissioning of the production string to assure that no fluid flows through the ICD or autonomous ICD. The PAV retains pressures in both directions i.e. an external pressure from the reservoir and an internal pressure from the production string up to a set value/design pressure. At an internal pressure above the set value the PAV will be activated and then opened for flow when the pressure is released. Once the PAV is activated/open it may be permanently or temporarily open for flow in both directions depending on the configuration. The PAV does not have to restrict or interfere with the base pipe standard full internal diameter and can be fitted to different sized pipes and sand screen configurations.

The PAV of the present invention is hence configured to prevent fluid from running through an ICD or an autonomous ICD at least during installation and commissioning of a production pipe of a well bore.

The PAV of the present invention comprises a cylinder open in both first and second longitudinal ends and a cylindrical piston moveably arranged within the cylinder. The piston is hollow allowing fluid to enter into a first longitudinal end section and closed at a second longitudinal end section hindering fluid from passing therethrough. The piston further comprises at least one radially arranged opening arranged adjacent to or abutting the second longitudinal end section. The PAV further comprises a seal arranged to interact with the piston and the cylinder.

Further, either the cylinder comprises a slot for receiving and guiding a stopper which is fixed to the piston or the piston comprises a slot for receiving and guiding a stopper which is fixed to the cylinder. The slot is configured to guide the stopper such that the piston is guided from i) a first position P1, wherein the piston is positioned in a pretensioned position by a spring, wherein the stopper is abutting a first end of the slot and wherein the piston is arranged such that the at least one radially arranged opening and seal are located within the cylinder, thereby hindering any fluid from flowing through the pressure activated valve; towards ii) a second position P2 by compressing the spring due to an internal pressure exerted on the piston, wherein the piston is moved in an at least partly helical path, due to the interaction between the slot and the stopper, towards the first end of the cylinder, until the stopper is abutting a second end of the slot;

and thereafter towards iii) a third position P3 by releasing the internal pressure exerted on the piston, wherein the piston is moved in a path, due to the interaction between the slot and the stopper, towards a second end of the cylinder until the stopper abuts a third end of the slot such that the seal allows fluid to pass through the PAV, at least when external pressure is applied to the PAV.

In the second position P2, the radially arranged openings and the seal are arranged within the cylinder.

The at least partly helical path of the slot in which the piston is moved from the first position P1 to the second position P2 may be shorter than the path of the slot which the piston is moved from the second position P2 to the third position P3.

Preferably, the path from the first position P1 to the second position P2 has a longitudinal length being from 5 to 70% of the longitudinal length of the path from the second position P2 to the third position P3, more preferably from 10 to 50%, even more preferably from 10 to 40%.

The at least one radially arranged opening of the piston may have any shape allowing fluid from the well formation to pass therethrough. In a preferred embodiment the at least one opening has a longitudinal opening which may have one of an oblong, oval and rounded corner rectangular shape extending in a longitudinal direction of the piston thereby increasing the amount of fluid passing through the PAV when open. Such shapes idealize the flow from the first to the second end without stagnation and the pressure drop is minimized.

The least one radially arranged opening may have a longitudinal length extending from any one of 5% to 60% or 10% to 50% or 10% to 40% of a maximum longitudinal length of the piston.

Further, the at least one radially arranged opening may have a circumferential extend of any one of 20° to 90° or 30° to 80° or 40° to 70°.

For allowing as much fluid as possible to pass through the piston when open, the piston may have at least three radially arranged openings arranged next to each other in the circumferential direction of the piston. The openings are preferably equally spaced apart from each other.

The piston further comprises an annular seal arranged at the second longitudinal end section. The seal may sealingly arrange the piston within the cylinder when the piston is in or between the first position P1 and second position P2 thereby hindering any fluid from flowing through the PAV. The seal may for example be an O-ring.

The second end section of the piston may comprise a second terminal end of the piston.

The seal may be arranged closer to the second terminal end of the piston than the radially arranged openings.

The first end section of the piston displays a first open terminal end of the piston allowing fluid to pass into the piston.

The slot is configured to guide the stopper therein when moving the piston within the cylinder. The slot may be in the form of a slit opening or a groove when arranged on the cylinder and may be in the form of a groove when arranged on the piston.

The stopper may comprise several components and the portion interacting with the slot may be free to rotate.

In a first example aspect of the PAV according to the present invention the cylinder may comprise the slot while the stopper is fixed to an outer surface of the piston.

The cylinder may comprise two identical slots and the piston may comprise two stoppers. The two slots and the two stoppers may further be arranged on oppositely facing sides of the cylinder and piston respectively.

The stopper may for example be a screw or bolt having a pin portion being arranged within the slot of the cylinder for interacting with the slot and a head portion arranged outside the cylinder. The pin portion may for example be molded onto the piston or screwed thereon by threads arranged at an end of the pin being inserted into a threaded hole of the piston. The end of the pin inserted into the piston is opposite the head portion of the pin. Hence, the slot is a slit opening with the stopper arranged therein. Further, the stopper may be spring loaded allowing movement in the radial direction of the piston.

The longitudinal distance of the path of the slot moving the stopper of the piston from the first position P1 to the second position P2 may preferably be shorter than the longitudinal distance of the path of the slot from the second position P2 to the third position P3 hence allowing the piston to extend beyond the inner surface of the cylinder when arranged in the third position P3. Hence, when the piston is arranged within the cylinder at the first position P1 and second position P2 the cylinder may be working as a seal prohibiting fluid form exiting the radial openings of the piston. A seal such as O-rings is arranged on the piston sealingly arranging the piston within the cylinder when the PAV is closed. Preferably, the seal can be arranged on the second terminal end section of the piston.

In a second example aspect of the present invention the piston of the PAV comprises the slot while the stopper is fixed to the cylinder.

The slot may be in the form of a groove arranged on the outer surface of the piston of the PAV. The outer surface of the piston is considered to be the surface facing the inner surface of the cylinder. Hence, the stopper is in this example aspect arranged on the cylinder. By moving the piston, the stopper is guided within a path formed by the groove on the piston.

Hence the PAV according to the second aspect may in an example embodiment have the same functions as disclosed for the first example aspect above but with inverse stopper and groove positions. The working principle/operation of the PAV of the second aspect can hence be very similar to the working principle of the first example aspect.

The path made by the groove may in another example embodiment allow for the PAV to be reversible on repressurization and may create an alternating fully opened and fully closed position for pressures in both directions i.e. both internal and external pressures.

In this second aspect the stopper should have a geometry that allows the stopper to interact within the path of the groove by sliding or rolling.

Further, the groove may have a configuration that only allows the stopper to be guided in one direction, such as for example ramps.

The present invention also involves a system for preventing fluid from passing through an inflow control device during installation and commissioning of a production string in a well bore.

The system comprises

- the production string or a production string joint,
- the inflow control device arranged within a wall of the production string or the production string joint,
- the PAV arranged outside the production string being configured to hinder fluid from entering the inflow control device from a reservoir when the PAV is closed and to allow fluid from entering from the reservoir when PAV is open.

Preferably the inflow control device of the system is an autonomous inflow control device.

The present invention also involves a method for preventing fluid flow through an ICD or autonomous ICD arranged within a wall of a production string using a PAV in accordance with the system disclosed above.

The method comprises the steps of:

- installing the piston of the PAV in a closed first position wherein the piston is exposed to a pressure by a spring force of a set value;
- exerting an internal pressure above the set value, wherein the internal pressure is exerted from the production string towards the PAV such that the piston moves into a closed second position;
- releasing the internal pressure forcing the piston to an open, third position P3.

It should be understood that the longitudinal direction of the cylinder may be the same as the longitudinal direction of the production string.

Further, the term "longitudinal direction" should be understood as the direction along the longitudinal length of the cylinder of the PAV.

The term "longitudinal distance" should be understood as a distance along the longitudinal direction of the cylinder.

The term "set value/design pressure" is the spring force that the piston is exposed to in its first position before activation of the PAV by the activation pressure. Hence the design pressure can be understood as the pressure generating a force that is equal to the spring's pretensioned force when the piston is positioned in the pretensioned first position wherein the stopper is preloaded. Hence, pressure lower than the design pressure will not move the piston while pressure above the design pressure will move the piston.

The term "activation pressure" should be understood as the internal pressure needed to be exerted on the piston to move the piston from the first position to the second position.

It should be understood that the movement of the piston within the cylinder is dependent on the path of the slot. Together with the pressure exerted/not exerted on the piston, it is the interaction between the slot and the stopper that decides the movement of the piston within the cylinder.

A person skilled in the art will understand that the activation pressure necessary to activate the PAV is not an internal pressure of a certain value, but an internal pressure above a certain value (set value/design pressure) for activating the PAV, hence moving the piston from the first to the second position.

A person skilled in the art will understand that the piston of the PAV can be moved back to the second position, P2, after being arranged at the third position, P3, by means of e.g. an additional mechanisms such as an additional spring that use flow or pressure differentials such that the piston and hence the seal can be re-engaged and be temporarily closed.

For example, the piston of the PAV can be moved back towards the second position, P2, after being arranged at the third position, P3, if the PAV is made such that it is biased to close the opening in an intermediate position, e.g. by shortening the stroke of the spring and adding a second opposing spring. In this design the PAV will obtain a check-valve function after activation. It will open on flow into the well by the external pressure, but close if pressure is reversed. Increase in internal pressure of the production pipe will first seat the seal in the intermediate position between the second position P2 and the third position P3, then the piston will move inside the cylinder to position P2 where the pressure can further be increased without movement of the piston. When the pressure is again released the piston will go back to the intermediate check valve state i.e. the piston will be moved into the intermediate position.

The specific design pressure and internal activation pressure can be varied over a large range by using springs with different characteristics/stiffness.

Above-discussed preferred and/or optional features of each aspect may be used, alone or in appropriate combination, in the other aspects of the invention.

BRIEF DESCRIPTION OF THE DRAWINGS

These and other characteristics of the invention will be clear from the following description of embodiments, given as non-restrictive examples, with reference to the attached sectional sketches and drawings wherein.

In the drawings, like reference numerals have been used to indicate like parts, elements or features unless otherwise explicitly stated or implicitly understood from the context.

DETAILED DESCRIPTION

In the following, embodiments of the invention will be described in more detail with reference to the drawings. However, it is specifically intended that the invention is not limited to the embodiments and illustrations contained herein but includes modified forms of the embodiments including portions of the embodiments and combinations of elements of different embodiments as come within the scope of the following claims.

It is appreciated that certain features of the invention, which, for clarity, have been described above in the context of separate embodiments, may also be provided in combination in a single embodiment. Conversely, various features of the invention, which, for brevity, have been described in the context of a single embodiment, may also be provided separately or in any suitable sub-combination. In particular, it will be appreciated that features described in relation to one particular embodiment may be interchangeable with features described in relation to other embodiments.

Figure 1:
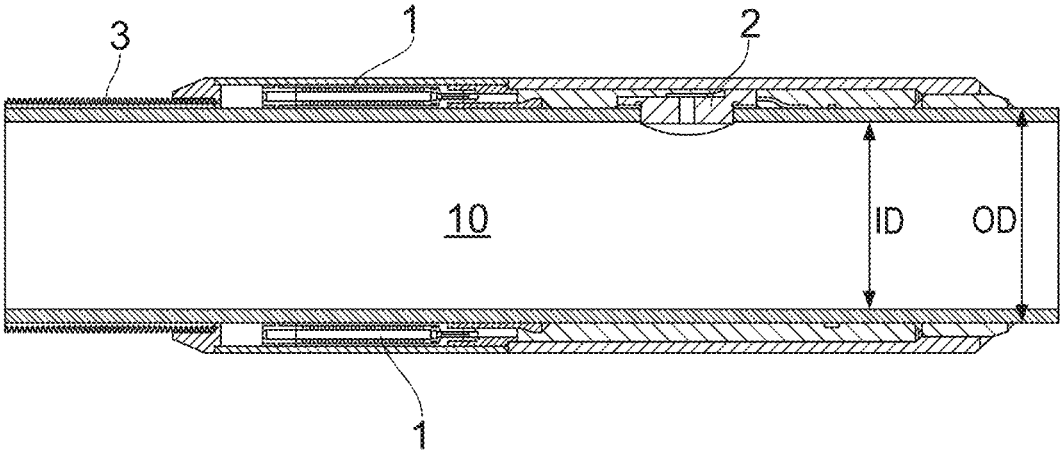
FIG. 1 is cross sectional view of a system having a production string, AICV, PAVs and sand screen.

FIG. 1 shows a cross section of a typical layout of a production string 10 with a sand screen 3, PAV 1 and an automated ICD, referred to as an AICV 2, mounted in series. As shown, a plurality of PAVs 1 can be circumferentially distributed around the annular production string 10.

The AICV 2 is mounted within the wall of the production string 10 to create a flow path there through, while the PAVs 1 and sand screen 3 are mounted on the outside of the production string along the outer surface thereof.

As shown in FIG. 1, the PAVs 1 do not restrict or interfere with the production string's 10 standard full internal diameter ID. During production, fluid passes through the sand screen 3, through the PAV 1, set in open position, and through the AICV 2 which will be open or closed depending on the characteristics of the fluid entering from the PAV 1.

Figure 2:
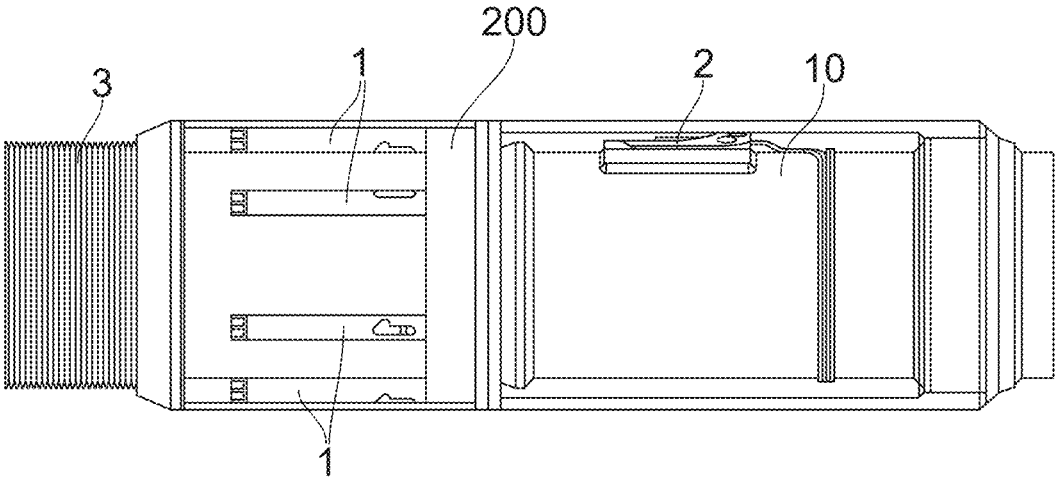
FIG. 2 is an open/transparent perspective view of the system of the invention showing the sand screen, PAVs and AICV.

FIG. 2 is a perspective view of how a plurality of PAVs 1 can be arranged around the production string 10 and shows how the system of the invention comprising the sand screen 3, PAVs 1 and an AICV 2 are assembled. Each PAV 1 is mounted into a ring 200. The ring can contain a single PAV 1 or a plurality of PAVs 1 as shown. The ring 200 is welded to the production string such that flow or pressure communication to the reservoir must go through the PAVs 1. The PAVs 1 are sealed against the ring 200 using seals, such as polymer, elastomer or metal seals. When internal pressure acts on the piston 104 of each PAV 1, the spring forces will open them all when the internal pressure is released.

Figure 3:
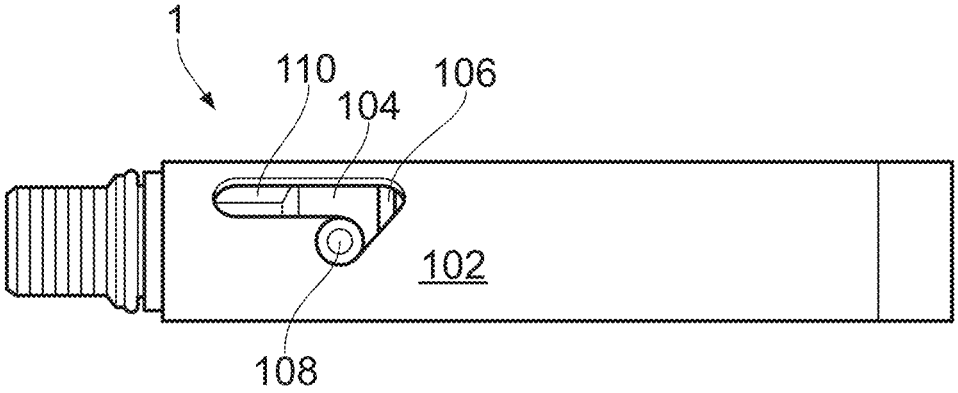
FIG. 3 is a perspective view of the inventive PAV according to the first example embodiment.

FIG. 3 is a perspective view of a PAV 1 according to a first example embodiment of the first aspect of the PAV 1 showing the cylinder 102 having two slots 110, even if only one is visible. Further, the shown stopper 108 of the piston 104 is arranged in the first position P1 being pretensioned by the force from the spring 106 into the shown abutting position.

Figure 4A:
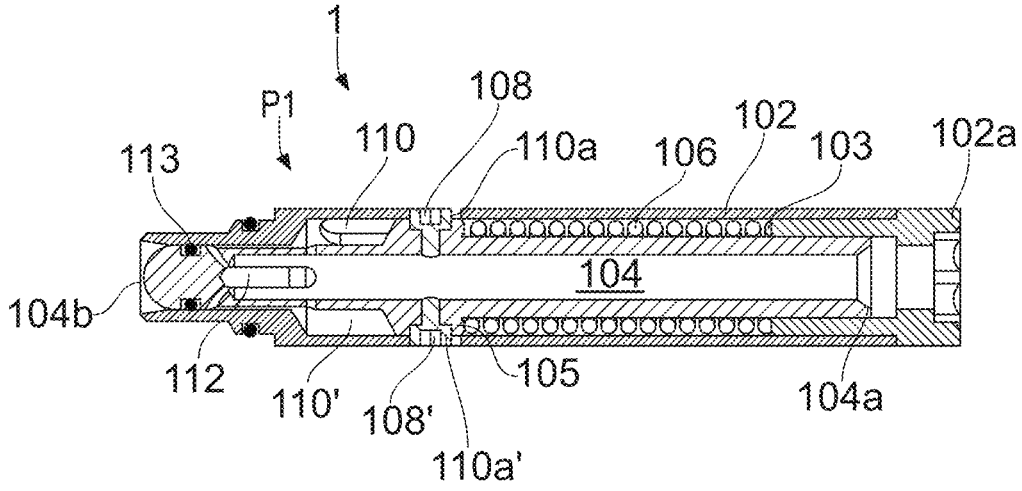
FIG. 4A is a cross-sectional view of the first example embodiment of the inventive PAV in the first position P1.
Figure 4B:
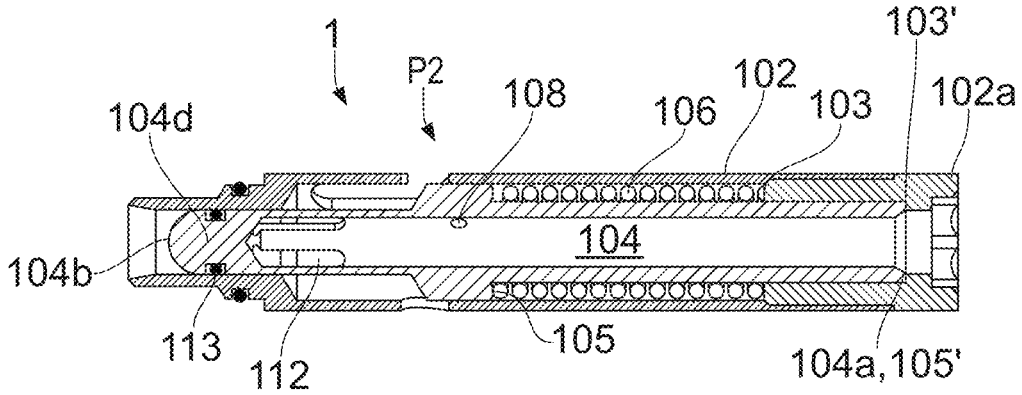
FIG. 4B is a cross-sectional view of the first example embodiment of the inventive PAV in the second position P2.
Figure 4C:
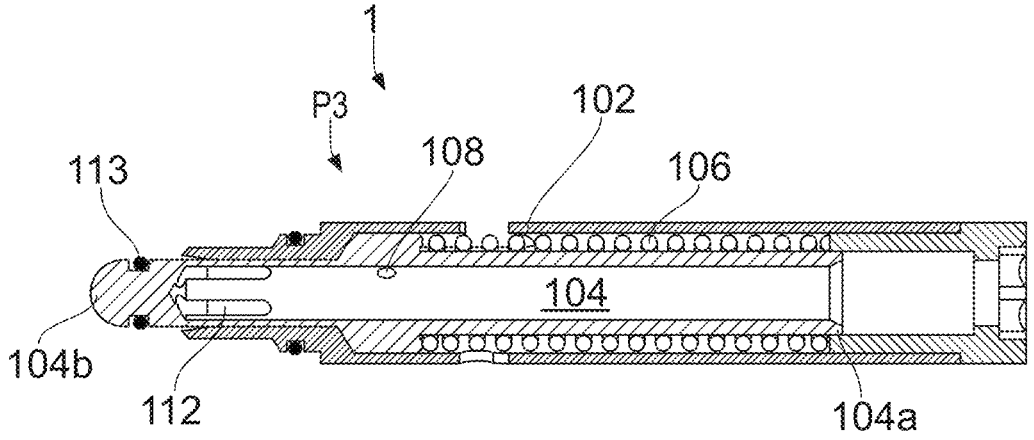
FIG. 4C is a cross-sectional view of the first example embodiment of the inventive PAV in the third position P3.

FIGS. 4A to 4C are cross-sectional views of the PAV 1 shown in FIG. 3 and FIGS. 5A to 5C are open transparent side views of the PAV 1 shown in FIGS. 4A to 4C. The PAV 1 is shown in the pretensioned closed position P1 in FIGS. 4A and 5A, in a closed second position P2 in FIGS. 4B and 5B and in an open third position P3 in FIGS. 4C and 5C.

Figure 5A:
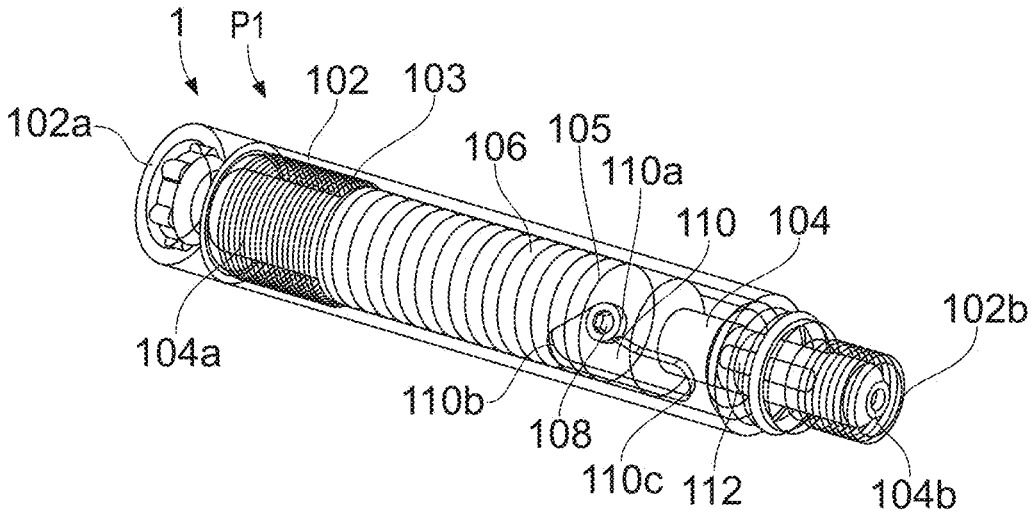
FIG. 5A is an open/transparent perspective view of the first example embodiment of the inventive PAV in the first position P1.
Figure 5B:
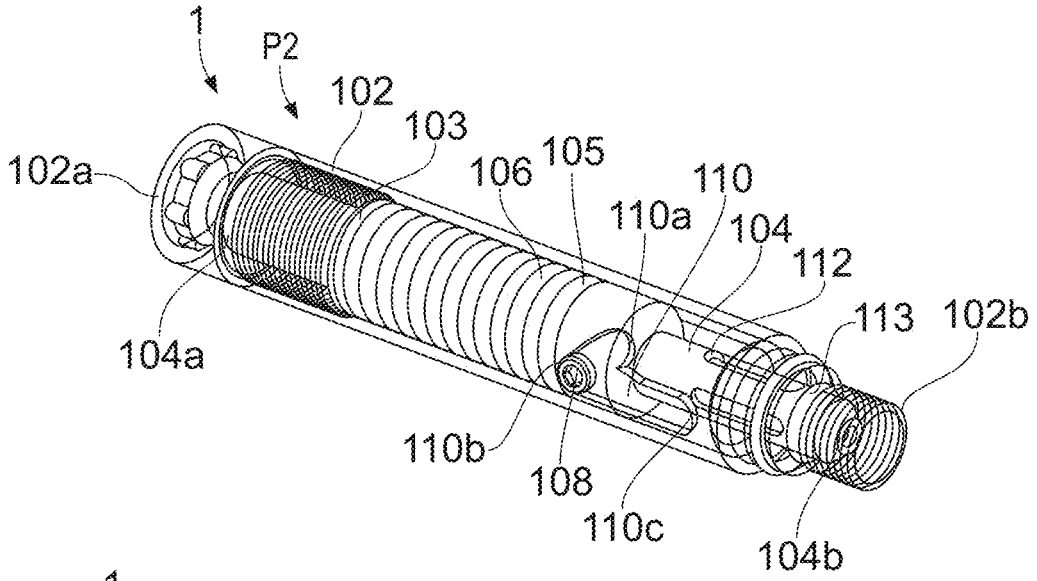
FIG. 5B is an open/transparent perspective view of the first example embodiment of the inventive PAV in the second position P2.
Figure 5C:
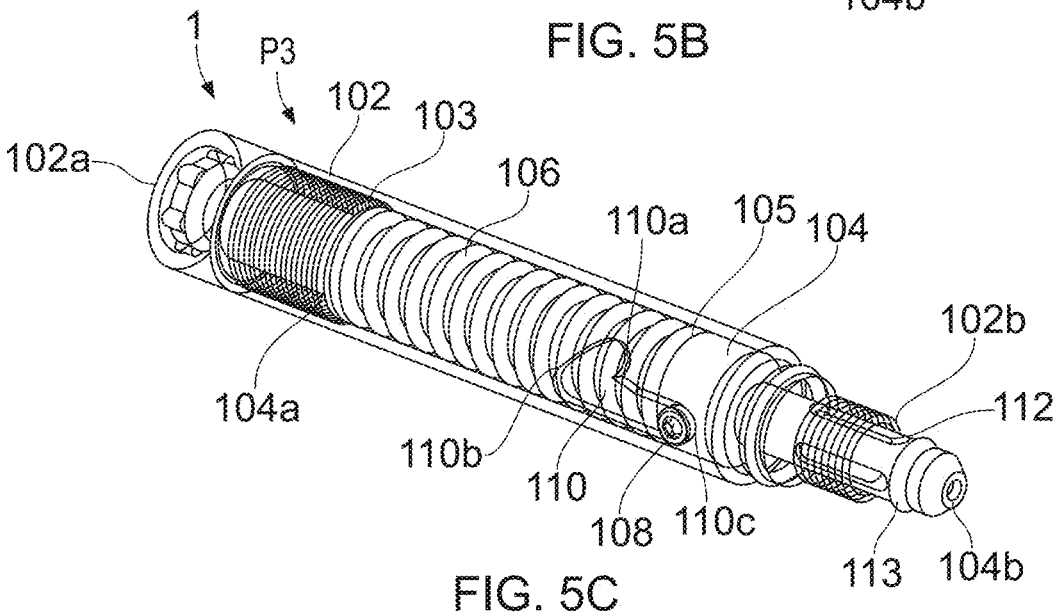
FIG. 5C is an open/transparent perspective view of the first example embodiment of the inventive PAV in the third position P3.

With reference to FIGS. 3, 4A to 4C and 5A to 5C, the PAV 1 comprises a hollow cylinder 102 having a moveable cylindrical piston 104 arranged therein moving in the longitudinal direction L (see FIG. 3) of the cylinder 102. The piston 104 is hollow and open at the first longitudinal terminal end 104*c* of the first end section 104*a* allowing fluid to enter into the piston 104 but is closed at the second longitudinal terminal end 104*d* of the second end section 104*b* hindering fluid from passing therethrough. In the drawings the hole end section 104*b* is closed. The radially arranged openings 112 of the piston abut the second end section 104*b* of the piston 104. The radially arranged openings 112 allow fluid to pass through the PAV 1 when the seal/O-ring 113 is arranged outside the cylinder 102, i.e. when the PAV 1 is in the third (open) position P3 as shown in FIGS. 4C and 5C. The openings 112 have a longitudinal oblong shape. As shown, the second end section 104*b* of the piston 104 comprises the seal/O-ring 113 which sealingly arranges the piston 104 within the cylinder 102 when the PAV 1 is closed.

The spring 106 is arranged within a recess between the piston 104 and the cylinder 102 abutting a first piston rim 105 of the piston 104 at the one end which can be arranged near or approximate to the stoppers 108,108' and a first cylinder rim 103 of the cylinder 102 at the other opposite end being arranged closer to the first longitudinal end 102*a* of the cylinder 102.

In other words, the piston 104 has a larger outer diameter at an area including the stoppers 108,108' such that the outer surface of the piston 104 facing the inner surface of the cylinder 102 comprises the first piston rim 105. Further, an area of the cylinder 102 including the first end 102*a* of the cylinder 102 has a smaller inner diameter than the remaining part of the inner surface of the cylinder 102 such that the inner surface of the cylinder 102 comprises the first cylinder rim 103.

As seen in FIGS. 4A and 5A the spring 106 is pretensioned between the first piston rim 105 and the first cylinder rim 103 as the piston 104 is arranged in the first position P1.

In this first position P1, the spring force is directed from the cylinder rim 103 towards the piston rim 105 such that the stoppers 108,108' are simultaneously pushed towards the first ends 110*a*, 110*a'* of the slots 110,110'. The piston 104 is fully arranged within the cylinder 102 such that the PAV 1 is closed, thereby prohibiting fluid from passing therethrough, and hence prohibiting fluid from passing through the ICD/automated ICD. The spring force shall be chosen such that the piston 104 is not moved below a limiting design pressure which may be around 170 bars (around 2500 psi).

If the design pressure is exceeded, i.e. applying an internal activation pressure to the piston 104 in the opposite direction of the force of the spring 106, the slots 110,110' guide the stoppers 108,108' from the first (closed) position P1, and hence the piston 104 to the second intermediate position P2 as shown in FIGS. 4B and 5B. This occurs since the internal pressure applied on the piston 104 creates an applied force that exceeds the opposite force applied by the pretensioned spring 106. The spring 106 is hence further compressed and the stoppers 108,108' are simultaneously guided within the paths of the slots 110,110' in the direction circumferential and radial direction towards the first end 102*a* of the cylinder 102 until reaching the second ends 110*b*,110*b'* of the slots 110,110'. The piston 104 is then arranged in the second position P2.

Further, the piston 104 may comprise a second piston rim 105' at the first end section 104*a* of the piston 104 which may abut a second cylinder rim 103' near the first end 102*a* of the cylinder 102. Such abutment between the piston 104 and the cylinder 102 allows the applied force to be spread over a larger area than if they were not present. Hence, the internal pressure executed on the stoppers 108,108' of the piston 104 is spread to the cylinder 102 unloading some of the pressure executed on the stoppers 108,108'. A person skilled in the art will understand that instead of a rim 103 of the cylinder 102 the cylinder 102 may comprise any kind of resistance such as a retainer screw, retaining plug or the like.

As shown, the cylinder 102 has a smaller inner diameter at or near its first end 102*a* creating the second cylinder rim 103' which abuts the second piston rim 105' when the piston 104 is arranged in the second position P2.

The paths of the slots 110,110' forces the stoppers 108, 108' of the piston 104 to move in a circumferential/radial path towards the first end 102*a* of the cylinder 102 when moving the piston from the first position P1 to the second position P2. Hence, the piston 104 is moved in the circumferential/rotational direction as well as in the longitudinal direction (i.e. in a partly helical path) until the stoppers 108,108' reaches the second ends 110*b*,110*b'* of the slots 110,110'. In this position the piston 104 is still fully arranged within the cylinder 102 such that the PAV 1 remains closed for fluid flow.

The activation pressure may for example be around 240 bars (3500 psi) which is the internal pressure applied to the production string for activating mechanical packers.

As the internal pressure is reduced or removed, the piston 104 is moved due to the spring force until it reaches the open third position P3, shown in FIGS. 4C and 5C. The stoppers 108,108' of the piston 104 are moved in a straight longitudinal path of the slots 110,110' towards second end 102*b* of the cylinder 102 until the stoppers 108,108' are, due to the force exerted by the spring 106, pushed towards/abutting the third ends 110*c*,110*c'* of the slots 110,110'. In this third position P3 of the piston 104, seal 113 of the piston 104 is extending outside the cylinder 102 such that the PAV 1 is open. Fluid is hence allowed to flow from the reservoir into the production string 10 via the PAV 1.

The spring force can be selected such that the spring 106 can be fully compressed when the piston 104 is in the second position P2 utilizing the spring 106 to a maximum. If the spring 106 is longer than the cylinder 102, the piston 104 will be tensioned in all positions after it is mounted along the production string 10. After release of the piston 104 into the third position P3, the piston 104 will still be tensioned, thereby preventing the PAV from closing due to internal pressures during operation such as backflow. However, the piston 104 may be fully extended having no tension at the third position P3 which also requires a force for moving the piston 104 back to the second position P2.

Further, the combined circumferential and longitudinal path of the slots 110,110', which guide the piston 104 from the first position P1 to the second position P2, is hindering the stoppers 108,108', when the piston 104 is arranged in the second position P2, to move back to the first position P1 when the internal pressure exerted on the piston 104 is released. The piston 104 will seek to move in a straight path, i.e. towards the third position P3. Hence the PAV 1 would be re-opened in the third position P3 after releasing the internal pressure and not closed in the first position, P1.

Further, the spring 106 can be free to rotate on one end so that torsional strain is not stored in the spring 106. Any torsion return motion may hence advantageously be smaller than the circumferential motion/rotation of the piston 104.

FIGS. 6A to 6E are open (transparent) side-views of a PAV 1 according to a second example embodiment which is in accordance with the second example aspect of the PAV of the present invention.

Figure 6A:
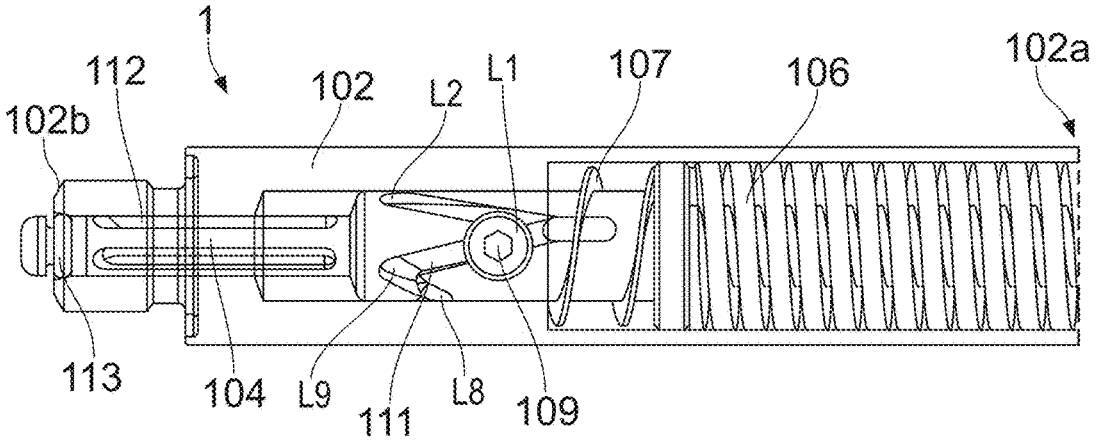
FIG. 6A to 6E are open (transparent) side-views of a PAV 1 according to a second example embodiment of the inventive PAV.
Figure 6B:
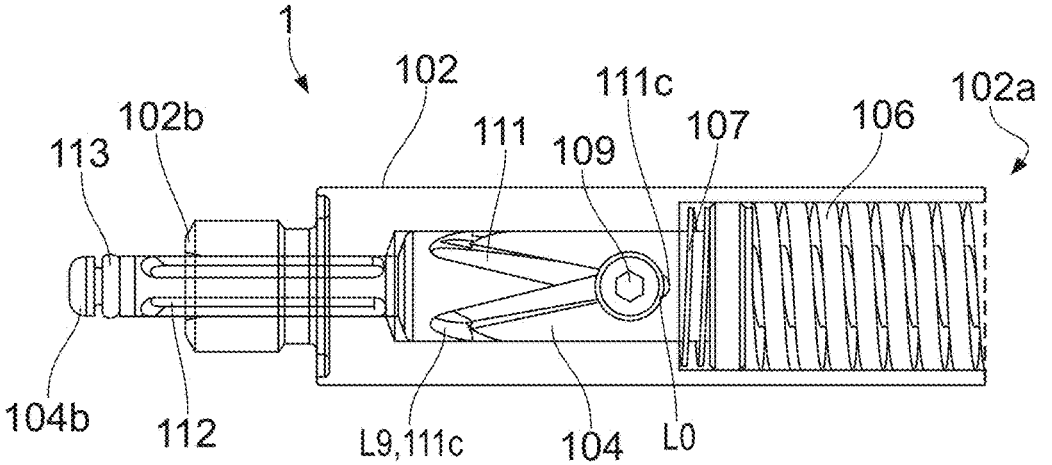
Figure 6C:
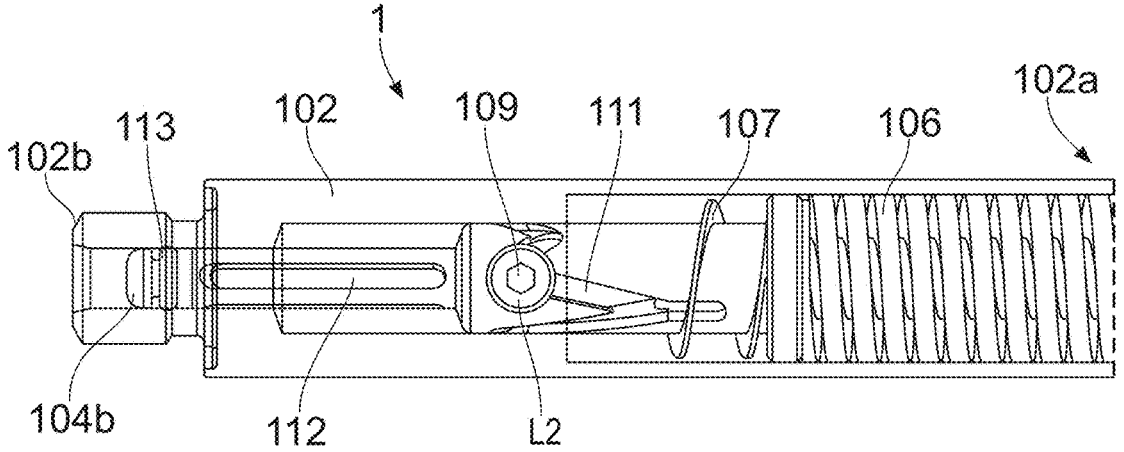
Figure 6D:
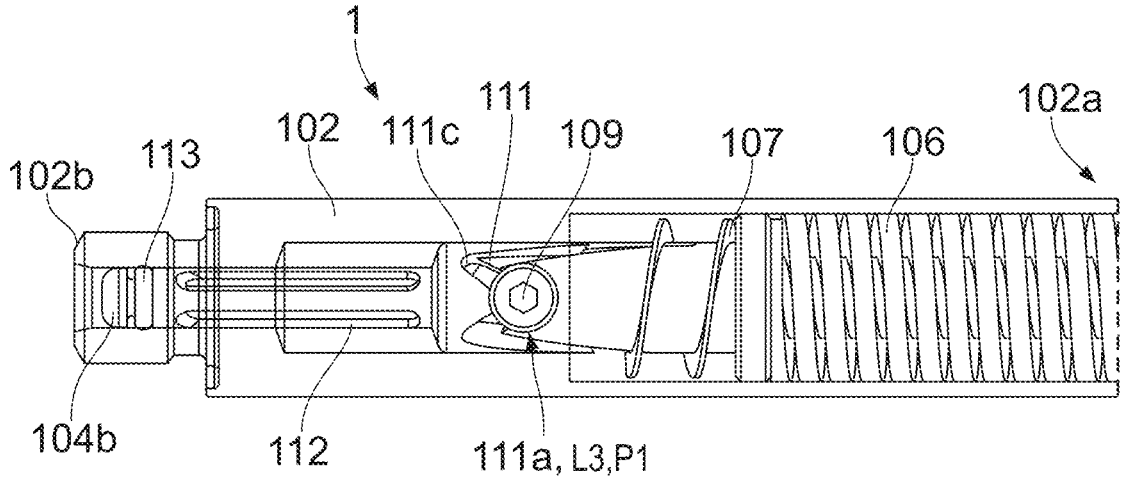
Figure 6E:
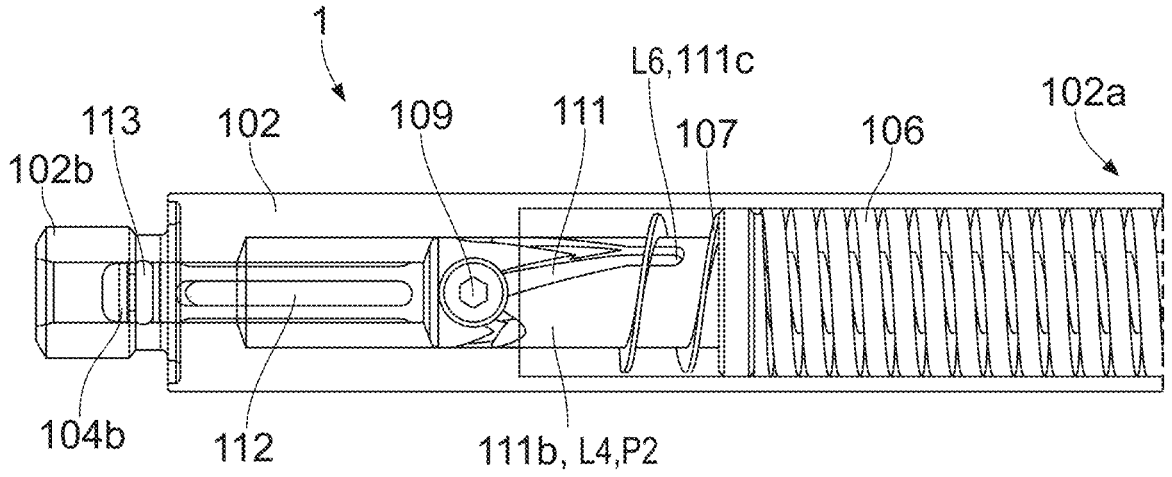
Figure 6F:
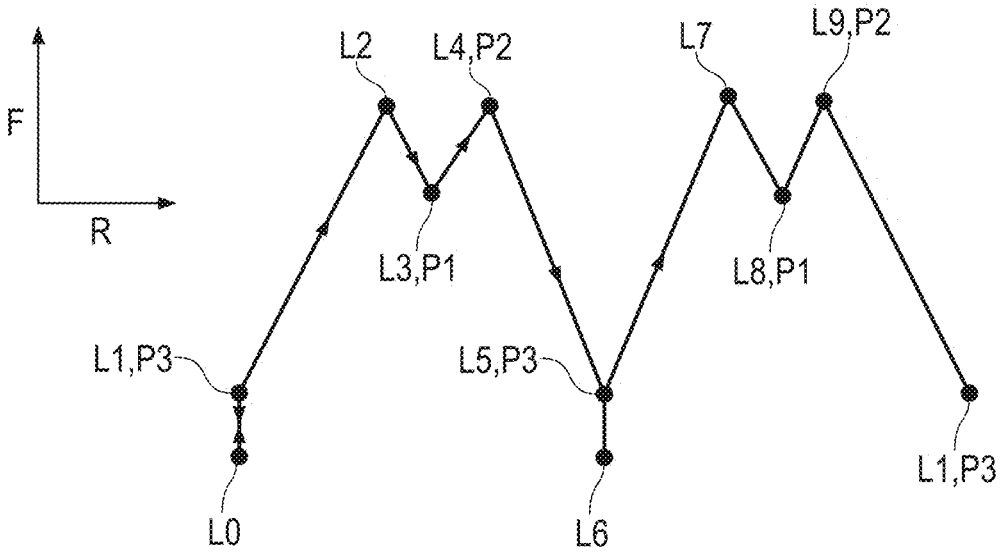
FIGS. 6F and 6G are illustrations of the path of the slot/groove of the PAV disclosed in FIGS. 6A to 6E.
Figure 6G:
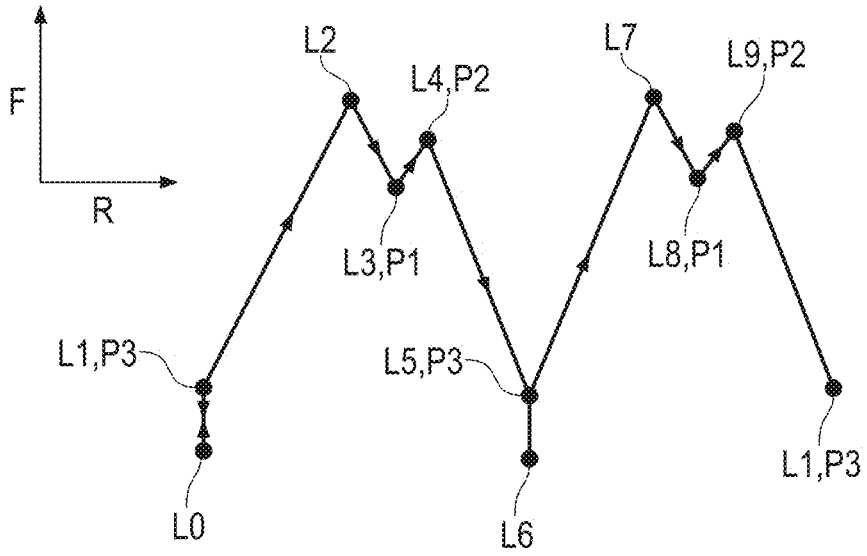

FIG. 6F discloses a first example of the path of the groove arranged on the piston, while FIG. 6G discloses a second example of a path of the groove on the piston both illustrating the full geometry of the groove when turning the piston one round i.e. 360°.

FIGS. 6F and 6G illustrate the path of the groove illustrated in FIGS. 6A to 6E and will be discussed in detail with regard to FIGS. 6A to 6E. As can be seen, the path shown in FIG. 6E differs from the path shown in FIG. 6G in that the fourth location L4 and the nineth location L9 are arranged differently. The path shown in FIG. 6G allows for less activation pressure F for moving the piston from the third location L3 to the fourth location L4 and from the eighth location L8 to the nineth location L9 than what is needed for the path shown in FIG. 6F. The direction of the activation pressure/internal pressure is indicated as arrow F while the circumferential direction of the piston is indicated by arrow R. It should be understood that the external pressure is opposite the internal pressure.

The configuration of the path illustrated in FIG. 6G is especially designed for a system comprising a plurality of PAVs 1 wherein there is a risk that the PAVs 1 operate unsynchronized. In such a system the PAVs can be forced back to being synchronized by applying an activation pressure F which is equal to or slightly larger than the pressure needed to move the piston such that the stopper engages at the fourth location L4 when moving from the third location L3 or engages at the nineth location L9 when moving from the eighth location L8, or is moved to an position between the first location L1 and second location L2 when moving from the zero location L0 or first location L1, or is moved to an position between the fifth location L5 and seventh location L7 when moving from the sixth location L6 or fifth location L5. As long as the activation pressure does not exceed the pressure needed for the piston to move the stopper of any of the PAVs 1 into the second location L2 or seventh location L7 the piston will move the stopper into the first location L1 or fifth location L5 upon releasing the activation pressure and hence all the PAVs 1 will be synchronized.

FIGS. 7A to 7D are cross-sectional views of the same illustrated PAVs 1 in FIGS. 6A to 6D, respectively.

FIGS. 6A to 6E and 7A to 7D show the cylinder 102 having a stopper 109 fixed thereto, and where the piston 104 has a slot 111 in the form of a groove 111 for guiding the stopper 109 therein.

Hence the working principle wherein the stopper 109 is arranged on the cylinder 102 and the slot/groove 111 is arranged on the piston 104 would work in the same manner as disclosed for the first example embodiment of the first aspect of the invention in FIGS. 3, 4 and 5 and is hence not shown. A person skilled in the art will understand that it is the relative movement between the piston and cylinder that is important when operating the PAV.

However, the working principle of the second example embodiment of the PAV 1 in FIGS. 6A to 6E and FIGS. 7A to 7D are different from the working principle shown for the first example embodiment in that the groove 111 has a continuous path along the circumferential direction of the piston 104. Hence, the concept of the PAV 1 differs from the previously described embodiment in that the piston 104 of the PAV 1 can be arranged in alternating positions and hence allowing for continuous open and closed cycles. Further, the PAV of the second example embodiment comprises a first spring 106 and a second spring 107 working in opposite directions, wherein the second spring 107 is a soft/less powerful spring compared to the first spring 106.

A person skilled in the art will understand that more than two full cycles can be completed by changing the design of the groove to comprise more cycles. Further, a person skilled in the art will recognize that more stoppers can be arranged on the cylinder for interacting with the groove as long all the stoppers are arranged to work in parallel.

In the following the concept of the configuration of the PAV 1 as shown in FIGS. 6A to 6E and FIGS. 7A to 7C will be disclosed in relation to the locations L0 to L9 of the groove 111 of the piston 104 as shown in FIGS. 6F and 6G.

Figure 7A:
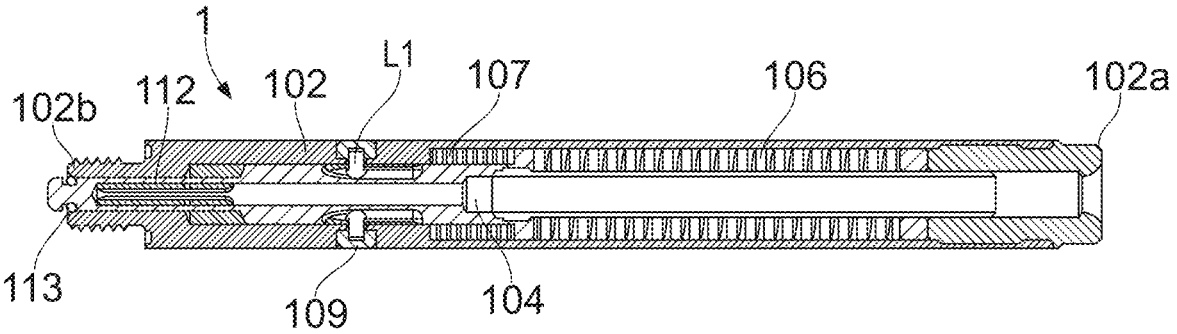
FIGS. 7A to 7D are cross-sectional side views of the PAV shown in FIGS. 6A to 6D respectively.

FIGS. 6A and 7A shows the piston 104 at a position wherein the stopper 109 of the cylinder 102 is arranged at a first location L1 (see also FIGS. 6F and 6G). At this first location L1 the first spring 106 is in a relaxed unloaded state. The second spring 107 is pushing the piston 104 such that the O-ring 113 seals the piston to the cylinder 102 and no fluid can pass through the PAV 1. Further, there is no external pressure, or at least no external pressure exceeding the pressure of the second spring 107, applied to the PAV 1. However, if the PAV 1 should be subjected to internal pressure from the production string, the PAV will remain closed as will be disclosed with relation to FIGS. 6C and 7C.

Figure 7B:
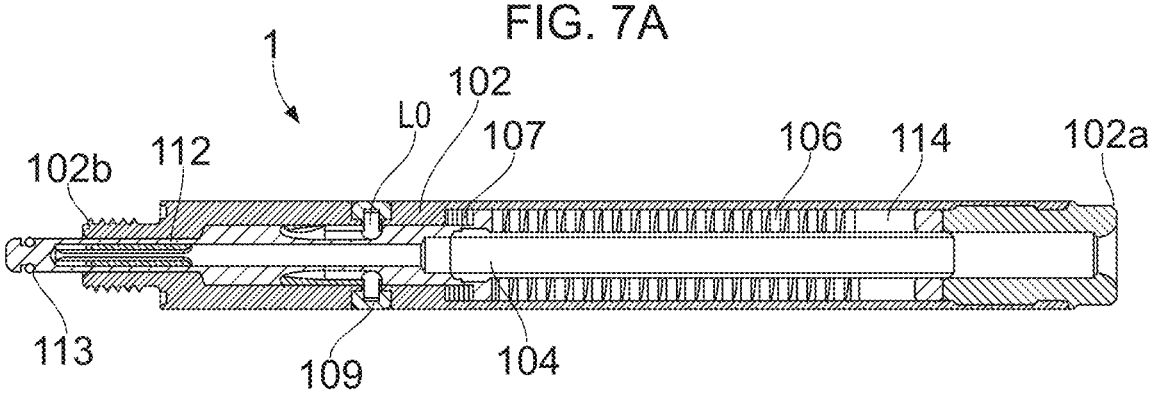

Upon subjecting the PAV 1 to external pressure from the well bore, the piston 104 of the PAV 1 will be forced into the open position wherein the stopper 109 is at a so-called zero location L0 (being the same as the third position P3) where the stopper abuts a third end 111*c* of the groove 111 as illustrated in FIGS. 6B and 7B. In this position the PAV 1 is open allowing fluid from the bore well to pass through the PAV 1. The external pressure must however exceed the opposite force executed by the soft second spring 107. Hence the piston 104 is moved such that the O-ring 113 and the preferably also at least a part of the radially arranged holes 112 are positioned outside the cylinder 102. In this position the soft second spring 107 is compressed by the external pressure, while the first spring 106 is still in the relaxed state and as shown leaving an empty volume 114 near the first end 102*a* of the cylinder 102. This volume 114 could however be filled with another guided or fully compressible spring to avoid loose parts, or reengaging contact surfaces.

Upon release of the external pressure from the well bore the piston 104 will move until the stopper 109 reaches back to the first location L1 due to the force from the soft second spring 107 pushing the piston 104, and hence be closed.

If the PAV 1 is again subjected to external pressure from the bore well, the piston 104 will move such that the stopper 109 is returned to the open zero location L0 allowing fluid to pass through the PAV 1 as long as the external pressure exceeds the pressure of the soft second spring 107.

Figure 7C:
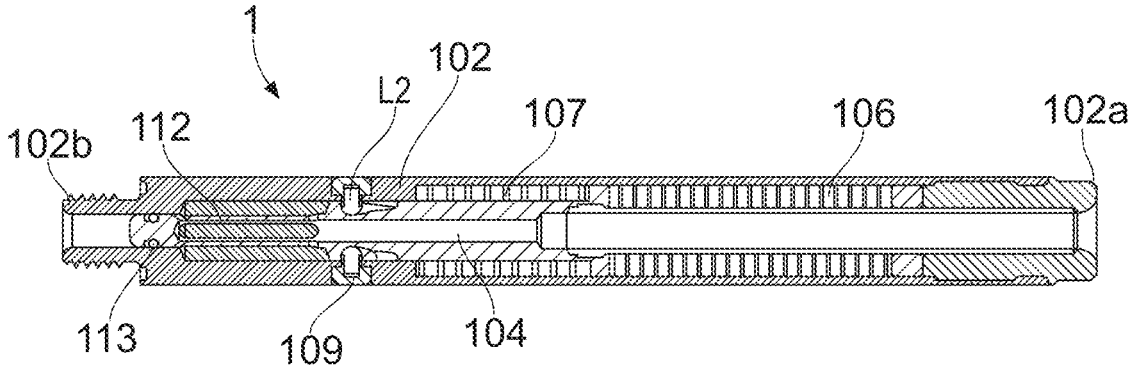
Figure 7D:
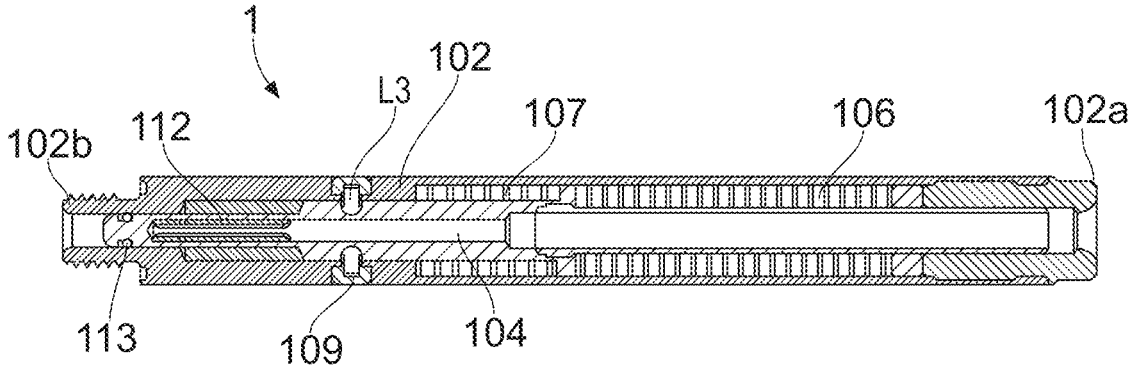

If however the PAV 1 is subjected to internal pressure from the production string, the piston 104 will be moved such that the stopper 109 is forced towards a second location L2 by compressing the first spring 106 until the piston 104 is moved such that the stopper 109 engages at the second location L2. At the second location L2 the PAV 1 is closed due to the internal pressure exceeding the pressure from the first spring 106 forcing the piston to the second location, L2. In this position the soft second spring 107 is in a relaxed state. This is illustrated in FIGS. 6C and 7C.

By releasing the internal pressure, the stopper 109 will, due to the movement of the piston 104, be forced to move into a third location L3 of the groove 111 corresponding to the first position P1 wherein the stopper 109 rests in equilibrium abutting a first end 111*a* of the groove 111 and the first spring 106 is in a pretensioned position. The second spring 107 is still unloaded i.e. in a relaxed state. See FIGS. 6D and 7D. Also at this third location L3 of the groove 111 the PAV 1 is closed as the O-ring 113 and the openings 112 are arranged within the cylinder 102.

To move the piston 104 from where the stopper 109 is arranged in the third location L3 towards where the stopper 109 can be arranged in the fourth location L4 corresponding to the second position P2, an internal pressure exceeding the pressure from the first spring 106 must be applied to the PAV 1. Then the stopper 109 will engage at the fourth location L4 abutting a second end 111*b* of the groove as indicated in FIG. 6E. Hence if the PAV 1 is subjected to external pressure while the stopper 109 is arranged in the third location L3, the PAV 1 will not be able to open by moving the piston 104 such that the stopper 109 can engage at the sixth location L6 opening the PAV to allow fluid from the well bore to pass therethrough. Hence, an activation pressure being an internal pressure exceeding the pressure of the pretensioned first spring 106 must be applied for activating the PAV 1. This will activate the PAV 1 such that the piston 104 is moved until the stopper 109 reaches the fourth location L4.

By releasing the internal pressure, the piston 104 will move such that the stopper 109 engages at the fifth location L5, as shown in FIG. 6A being identical to the first location L1.

Hence upon applying external pressure the piston will move such that the stopper 109 engages at the sixth location L6 abutting the a third end 111*c* of the groove 111 such that the PAV 1 is open allowing fluid to pass through, being identical to the first location L1 as shown in FIGS. 6A and 7A. However, by applying internal pressure, the piston 104 will be forced to move towards the seventh location L7, i.e. such that the stopper 109 engages at the seventh location if the internal pressure exceeds the pressure applied by the first spring 106.

After the stopper has engaged at the seventh location L7, see FIGS. 6F and 6G, the piston will engage at the eighth location L8 corresponding to the third location L3 described before. Then an activation pressure must be applied to the PAV for activation thereof, hence an internal pressure exceeding the pressure of the first spring 106 must be applied for moving the piston 104 such that the stopper can engage in the nineth location L9 which in FIG. 6F corresponds to the pressure needed to move the piston to the seventh location L7, but which in FIG. 6G allows for a smaller activation pressure than the pressure to reach the seventh location L7. Upon removing the internal pressure, the piston 104 is moved back such that the stopper 109 engages the first location L1. Hence two cycles are completed when turning the piston one round i.e. 360°.

The groove 111 creates a path for the stopper 109 in both a radial direction and a longitudinal direction simultaneously when moving the piston, hence the geometry of the piston 104 can further be biased to motion in one direction via rotational locks at each extreme, especially at a second location L2, third location L3, a fourth location L4, a seventh location L7, a eighth location L8 and a nineth location L9, and/or a sustained torque can be applied by a torsional spring member, ratchet, or other similar mechanisms which can be installed for rotating the piston 104.

Figure 8A:
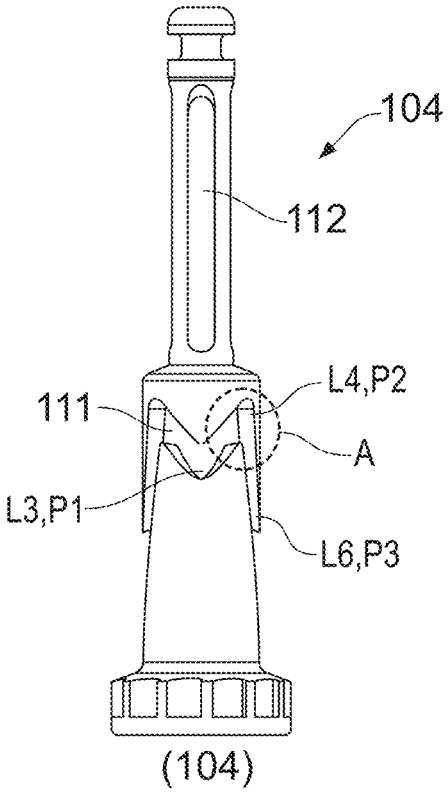
FIG. 8A is a perspective view of the piston of the PAV shown in FIG. 6A to 6E.
Figure 8B:
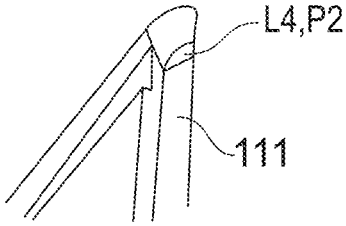
FIG. 8B is a close up view of the circled area A of FIG. 8A.
Figure 8C:
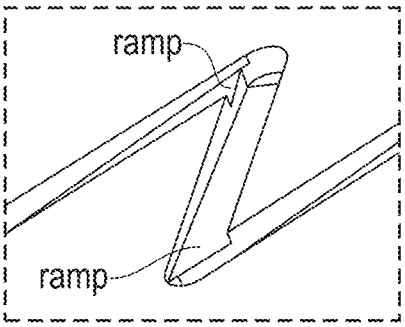
FIG. 8C is a close up view of the slot/groove path from FIG. 8A.

The PAV 1 of FIGS. 6A to 6E and 7A to 7D have a geometrical lock where the groove 111 is ramped at the second location L2, third location L3, fourth location L4, seventh location L7, eighth location L8 and nineth location L9, and the stopper 109 is spring loaded such that the stopper 109 drops into the depressions caused by the ramps at each extreme to prevent back-travel of the piston 104 as illustrated in FIGS. 8A and 8B.

FIG. 8A shows the piston of the PAV shown in FIGS. 6A to 6E and 7A to 7D. A part the path of the slot 111 configured as a groove 111 is shown on the outer surface of the piston 104.

The dashed circle A in FIG. 8A is explored in FIG. 8B illustrating that the groove 111 is ramped 111' adjacent the second and third locations L2,L3. The same ramped structure is also arranged adjacent the fourth location L4 even if not shown.

Even if not illustrated in the FIG. 6A-6E or 7A to 7D, the cylinder 102 may comprise more than one stopper 109, which may be arranged on oppositely facing sides of the piston 104 in respective of the radial direction. The groove 111 may hence guide more than one stopper 109 parallelly.

A person skilled in the art will understand the embodiment shown in FIGS. 6A to 6E and 7A to 7D could also be working by arranging the groove on the inner surface of the cylinder and by arranging the stopper on the piston.

The invention claimed is:

1. A pressure activated valve for preventing fluid from flowing through an inflow control device during installation and commissioning of a production pipe of a well bore, comprising:

a cylinder open in both first and second longitudinal ends a cylindrical piston moveably arranged within the cylinder, wherein the piston is hollow allowing fluid to enter into a first longitudinal end section and closed at a second longitudinal end section hindering fluid from passing therethrough, wherein the piston further comprises at least one radially arranged opening adjacent to the second longitudinal end section, a seal arranged to interact with the piston and the cylinder, wherein either the cylinder comprises a slot for receiving and guiding a stopper which is fixed to the piston or the piston comprises a slot for receiving and guiding a stopper which is fixed to the cylinder wherein the slot is configured to guide piston from i) a first position, wherein the piston is positioned in a pretensioned position by a spring, wherein the stopper is abutting a first end of the slot and wherein the piston is arranged such that the at least one radially arranged opening and seal are located within the cylinder, thereby hindering any fluid from flowing through the pressure activated valve; towards ii) a second position by compressing the spring due to an internal pressure exerted on the piston, wherein the piston is moved in an at least partly helical path towards the first longitudinal end of the cylinder, until the stopper is abutting a second end of the slot;

and thereafter towards iii) a third position by releasing the internal pressure exerted on the piston, wherein the piston is moved in a path towards the second longitudinal end of the cylinder until the stopper abuts a third end of the slot such that the seal allows fluid to pass through the pressure activated valve.

2. The pressure activated valve according to claim 1, wherein the cylinder comprises the slot and the stopper is fixed to an outer surface of the piston.

3. The pressure activated valve according to claim 2, wherein the cylinder comprises two identical slots and the piston comprises two stoppers, wherein the two identical slots and the two stoppers are arranged on oppositely facing sides of the cylinder and piston, respectively.

4. The pressure activated valve according to claim 1, wherein the piston comprises the slot and the stopper is fixed to the cylinder.

5. The pressure activated valve according to claim 1, wherein the at least one radially arranged opening has one of an oblong, oval, and rounded corner rectangular shape extending in a longitudinal direction of the piston.

6. The pressure activated valve according to claim 1, wherein at least one radially arranged opening has a longitudinal length extending from any one of 5% to 60% or 10% to 50% or 10% to 40% of a maximum longitudinal length of the piston.

7. The pressure activated valve according to claim 1, wherein the at least one radially arranged opening has a circumferential extend of any one of 20° to 90° or 30° to 80° or 40° to 70°.

8. The pressure activated valve according to claim 1, wherein the piston comprises at least three radially arranged openings.

9. The pressure activated valve according to claim 1, wherein the piston has a shorter longitudinal length than the cylinder.

10. The pressure activated valve according to claim 1, wherein the piston comprises the seal circumferentially arranged at the second longitudinal end section sealingly arranging the piston within the cylinder when the piston is in or between the first position and second position hindering any fluid from flowing through the pressure activated valve.

* * * * *